United States Patent [19]

Ohno et al.

[11] Patent Number: 4,993,651

[45] Date of Patent: Feb. 19, 1991

[54] YARN WINDING APPARATUS

[75] Inventors: Michio Ohno; Katsumi Hasegawa; Hiromitsu Kanamori, all of Kusatsu, Japan

[73] Assignee: Toray Industries, Inc., Tokyo, Japan

[21] Appl. No.: 418,279

[22] Filed: Oct. 6, 1989

[30] Foreign Application Priority Data

Oct. 7, 1988 [JP] Japan ..... 63-254634

[51] Int. Cl.[5] ..... B65H 54/547

[52] U.S. Cl. ..... 242/46.2; 252/46.4

[58] Field of Search ..... 242/46.2, 46.21, 46.3, 242/46.4, 46.5, 46.6, 46.7, 35, 68, 68.1, 68.2, 72 R, 72.1, 18 R

[56] References Cited

U.S. PATENT DOCUMENTS

| | | | |
|---|---|---|---|
| 3,526,369 | 9/1970 | Beckwith, Jr. | 242/46.4 |
| 3,547,362 | 12/1970 | Kallenborn | 242/46.5 X |
| 3,553,978 | 1/1971 | Williams . | |
| 3,917,182 | 11/1975 | Lenk | 242/18 R |
| 4,089,190 | 5/1978 | Worgan et al. . | |
| 4,575,015 | 3/1986 | Sugioka et al. | 242/46.4 |
| 4,811,910 | 3/1989 | Busenhart et al. | 242/46.4 |
| 4,852,819 | 8/1989 | Hasegawa et al. | 242/46.4 X |

FOREIGN PATENT DOCUMENTS

| | | |
|---|---|---|
| 234844 | 9/1987 | European Pat. Off. . |
| 53-61925 | 5/1978 | Japan . |
| 56-147916 | 11/1981 | Japan . |
| 1356393 | 6/1974 | United Kingdom . |

OTHER PUBLICATIONS

Japanese Industrial Standard, "Stainless Steel Pipes", JIS G 3459 by Japanese Standards Association.

Japanese Industial Standard, "Carbon Steels for Machine Structural Use", JIS G 4051 by Japanese Standards Association.

*Primary Examiner*—Stanley N. Gilreath

[57] ABSTRACT

A yarn winding apparatus for high speed yarn winding with long spindles and multiple bobbins having a reduced diameter, the apparatus having spindles with one or both of the bobbin holder or driving shaft made of a composite layer made of reinforcing fibers and a matrix component and a supporting member made of metal provided on at least one of an inner surface and outer surface of the composite layer.

20 Claims, 4 Drawing Sheets

YARN WINDING APPARATUS

BACKGROUND OF THE INVENTION

1. Field of the Invention

The present invention relates to a yarn winding apparatus, more particularly, to a yarn winding apparatus which enables one to wind yarn at a high speed on a long spindle having a small diameter while avoiding serious spindle vibration.

2. Description of the Related Art

Recent yarn winding apparatuses have been increased in the speed of the spindles with, for example, take yarn up at more than 5000 m/min, to improve the productivity of the yarn making process.

Also, use has been made of a spindle carrying multiple bobbins. In other words, a spindle having a relatively longer length, to further improve the productivity, since a plurality of yarn packages can be obtained in one winding operation.

A yarn winding apparatus having a longer spindle capable of carrying multiple bobbins is already known from EP 234,844, for example.

When spindles carrying multiple bobbins are put into practical use, the amount of the bobbins consumed will be increased remarkably since a large number of bobbins are mounted on the spindles in one yarn winding operation.

At the present time, bobbins are not collected for reuse but are scrapped after one use.

This is because great expense is required to manage and collect the bobbins both in term of equipment and personal.

Generally, the dominant expense in the production of bobbins is the material cost.

Bobbins having a relatively small diameter are thus naturally cheaper than bobbins having a relatively large diameter.

Also, when the diameter is reduced, the volume of yarn wound on a bobbin in one winding operation is increased, contributing to larger sized package.

Also, when the diameter is reduced, the volume of yarn wound on a bobbin having a small diameter, in other words, a spindle having a small diameter, and to increase the speed of the spindle for winding yarn and to elongate the spindles in a yarn winding apparatus.

In the prior art, there has not been a practical yarn winding apparatus which features simultaneously an increased rotational speed of the spindles, a greater spindle length, and a minimized spindle diameter.

Note that, conventional yarn winding apparatuses feature a maximum yarn winding speed of 6000 m/min, spindles made of metal and having a inner diameter of 120 mm and a total length of bobbins mounted on the spindles of 1200 mm.

Rotating bodies made of a composite layer made of reinforcing fibers and a matrix component are sometimes seen in the field of centrifugal separators.

A spindle of such a composite layer made of reinforcing fibers and a matrix component is very inferior to a spindle made of metal in mechanical strength, such as surface hardness, impact resistance, and wear and abrasion resistance. Therefore wear and deform action will occur on the sliding portion between a cylindrical body, i.e., a bobbin holder, and a bobbin fixing device, the connecting portion between the cylindrical body and a boss, the connecting portion between the boss and the driving shaft of the bobbin holder, and a bearing portion for supporting the driving shaft, due to frequent usuage of the yarn winding apparatus.

This wear and deform action cause considarable vibration, significantly reducing reliability and durability.

Therefore, spindles made of composite layer made of reinforcing fibers and a matrix component have not been used in practice.

On the other hand, a high speed rotating cylindrical body made of a composite layer made of reinforcing fibers and a matrix component and used for yarn winding apparatus is known in Japanese Unexamined Patent Publication No. 56-147916.

However, in the prior art, there is no information about the usage of a long spindle carrying multiple bobbins having a relatively small diameter for high speed yarn winding.

When a spindle made of a composite layer made of reinforcing fibers and a matrix component is used in a yarn winding apparatus, the precision of processing, the surface hardness, and the like of the sliding portion, the connecting portions, and the bearing portion are required to be high to enable high speed spindle performance.

In addition, this high level of precision should be maintained at a constant level without any variation with time caused by vibration due to rotation of the spindle, variation in package weight, or external force or stress, for example, the binding force created on the connecting portion.

When a yarn winding apparatus enabling high speed yarn winding with a long spindle made of metal having a small diameter is used, the increased spindle length naturally causes less stiffness of the spindle and a weaker supporting construction.

A separate problem arises in that other vibration will occur due to lack of spindle strenth, thus hindering high speed yarn winding.

Generally, it is believed that high speed yarn winding at a stable condition, requires that the spindle rotated at a high speed, be used without approaching the critical speed causing a considerable bending vibration, from the start to the end of yarn winding.

When high speed yarn winding is carried out utilizing a long spindle made of metal having a smaller diameter, for example, having an inner diameter of 94 mm and the whole length of 1200 mm, the critical speed is generally around 6000 m/min.

In other words, the critical speed drops to an unprecedantedly low range of yarn winding speed in which no critical speed occurs heretofore.

If vibration occurs in yarn winding at a speed of around 6000 m/min, it is difficult to continue stable yarn winding and furher there is mechanical damages to the yarn winding apparatus.

Thus, this kind of yarn winding apparatus cannot be used in practice.

SUMMARY OF THE INVENTION

The object of the present invention is to eliminate the drawbacks in the conventional yarn winding apparatus and to provide a yarn winding apparatus enabling yarn winding at a high speed with high reliability and durability with a long, samll diameter spindle without serious spindle vibration.

This is done by introducing the optimum conditions of spindle construction and materials used to significantly raise the critical speed.

To attain the object of the present invention, a yarn winding apparatus is provided including a spindle constructed of a cylindrical body, bobbins being detachably mounted on an external peripheral surface of which, and a driving shaft connected to the cylindrical body; a bobbin fitting and detaching means provided on the cylindrical body and a driving means for driving the spindle rotatably.

At least a portion of at least one of said cylindrical body and said driving shaft further is a composite layer made of reinforcing fibers and a matrix component and a supporting member made of metal connected to one or both of an inner surface and an extenal surface of the composite layer.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Other objects and advantages of the present invention will be more apparent from the following description with reference to the drawings illustrating preferred embodiments of the present inventions which are given by way of illustration only, and thus are not limitative of the present invention, and wherein.

DESCRIPTION OF THE PREFERRED EMBODIMENTS

Figure 1:
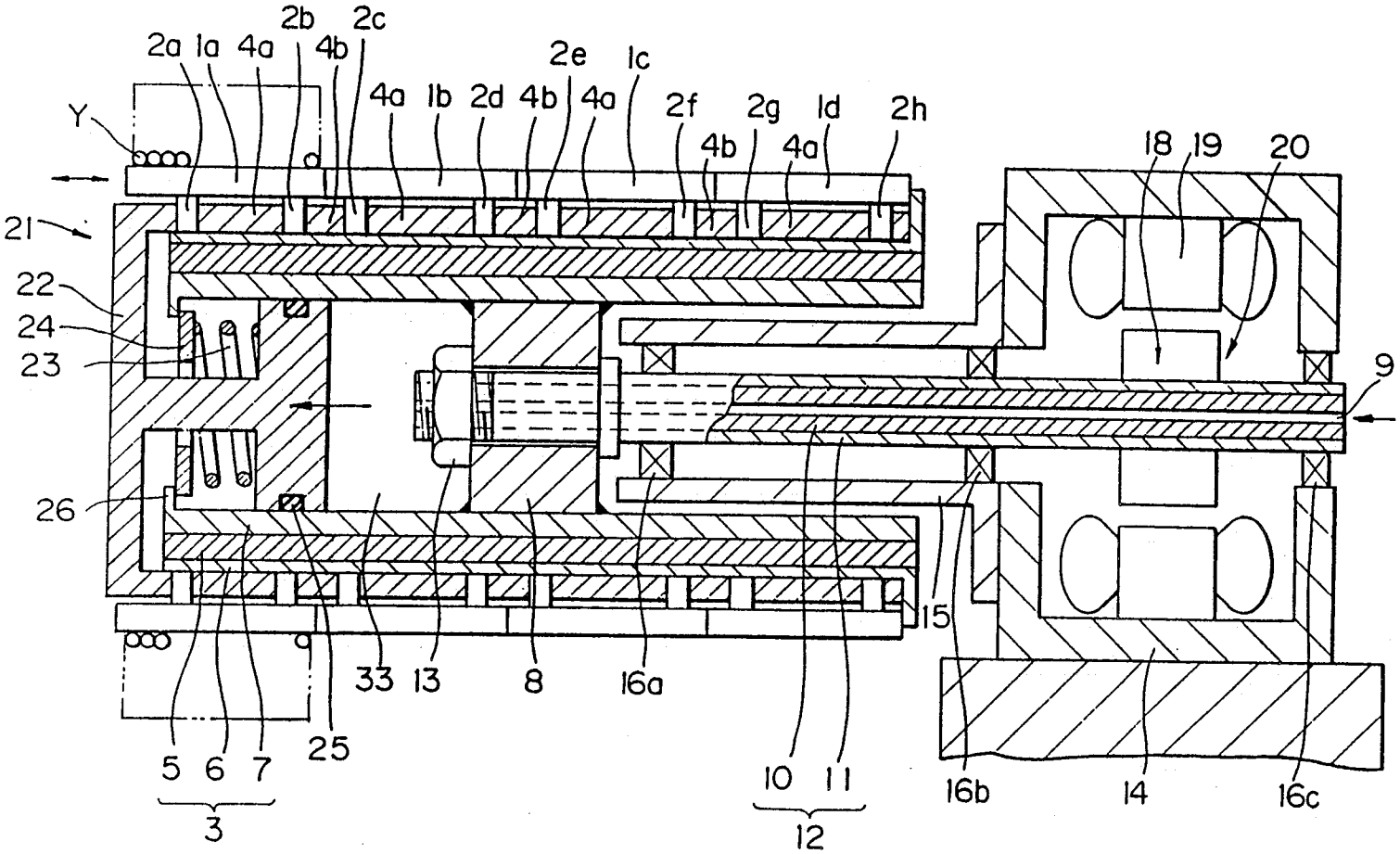
FIG. 1 is a cross sectional view of one example of a yarn winding apparatus of the present invention.

The bobbin used in the present invention is a cylindrical body for taking up a yarn on an outer surface thereof.

Any kind of known bobbin can be used.

The spindle used in the present invention also includes a cylindrical body, on an external peripheral surface of which the bobbins are mounted in quick detachable manner, and a driving shaft connected to the cylindrical body.

One or both of the cylindrical body and the driving shaft is made of a composite layer made of reinforcing fibers and a matrix component and a supporting member made of metal.

In the case of only one, the remaining cylindrical body or driving shaft may be a known cylindrical body or shaft disclosed in, for example, European Pat. No. 234,844, U.S. Pat. No. 3,917,182, U.S. Pat. No. 3,914,182, U.S. Pat. No. 3,553,978 U.S. Pat. No. 4,089,190, U.K. Pat. No. 1,356,363 or Japanese Unexamined Utility Model Publication No. 53-61925.

The spindle of the present invention has provided on it a known bobbin fitting and detaching means disclosed, for example, in European Pat. No. 234,844.

The composite layer is made of fibers selected from inorganic fibers, organic fibers, and metallic fibers and a suitable matrix component selected from suitable resin and metallic substances.

More specifically, high resilience carbon fiber obtained by baking acrylonitrile fibers or cellulose pitch at a high temperature, high resilience organic fiber mainly composed of an aromatic polyamide, for example, "KEVLAR" (Trademark of Du Pont Co.), or glass fiber can be used as the reinforcing fibers.

Thermosetting resins such as epoxy resins, an unsaturated polyester resins, phenol resins, and polyimide resins and thermoplastic resins such as polysulfonic resins, can be used as a matrix component.

In the present invention, in certain cases, a metal such as aluminum, magnesium, or copper can also be used as a matrix component.

Also, metallic fibers can be used as the reinforcing fiber.

Among the composite materials made of reinforcing fibers and a matrix component, explained above, a composite material which comprises high resilience fibers as a reinforcing fiber and epoxy resin as a matrix component is suitable for a yarn winding apparatus.

To increase the mechanical strength, such as the tensile strength and inter-layer shearing strength, required for materials to form a spindle, it is preferred that the weight percentage Vf of the reinforcing fibers to the matrix resin component be 40 to 75% more preferably 50 to 70%.

It is most effective for a spindle that winding angle $\theta$ of the reinforcing fiber to the cylindrical body, formed between the longitudinal direction of the reinforcing fiber and the axial direction of the cylindrical body, or driving shaft (acute angle), be close to 0 degree, since the Young's modulus E with respect to bending vibration of the bobbin holder is theoretically increased.

This winding angle may be designed to be a suitable degree depending upon the torque transferred to the bobbin, the value $E/\rho$, i.e., the ratio of the Young's modulus E to the density $\rho$, or the like.

In the present invention, it is very important that the value of $E/\rho$ is set as large as possible for improving the characteristics of the spindle.

Generally, the above angle is preferably 3 to 45 degrees, more preferably 3 to 30 degrees.

The composite layer used in the present invention may be formed by preparing a sheet like material made of fibers arranged in one direction and in parallel to each other as much as possible as stacking a plurality of the sheet-like materials with the yarn directions of the sheet like materials crossed or spirally winding the sheet like material on a suitable cylindrical body with a certain overlap, then immersing it in a matrix resin and performing a thermal-setting operation.

Further, the composite layer may be formed from a woven fabric or knitted fabric constituted by the reinforcing fibers explained above.

The methods for obtaining the composite layers per se are disclosed, for example, in U.S. Pat. No. 3,553,978, U.S. Pat. No. 4,089,190, and U.K. Pat. No. 1,356,393.

The supporting member is provided on one or both of the outer surface and inner surface of the composite layer and can be made of any metallic material widely known and conventionally used, such as carbon steel, tool steel, stainless steel, and rolled steel for general machine components.

As to the construction of the spindle, there are many different kinds of combinations of the composite layer made of reinforcing fibers and a matrix component and the supporting member made of the metallic layer.

Basically, at least one portion of at least one of the cylindrical body and the driving shaft comprises a composite layer and on one or both of an inside and outside surface of the composite layer, a metallic layer.

The cylindrical body may be made of the composite layer and the supporting member.

The composite layer is preferably provided on at least a portion of an inner surface of the cylindrical body.

The metallic layer may be provided on at least a portion of both an inner surface and an outer surface of the composite layer.

The driving shaft may also be made of the composite layer and the metallic layer.

The composite layer is preferably provided on at least a portion of an outer surface of the driving shaft.

The driving shaft may also mainly comprises a metallic layer and composite layer arranged alternately along the longitudinal direction thereof.

In this case, the composite layer and metallic layer are superimposed at their contact portions.

The following method can be used for integrating the fiber reinforced composite material and the metallic material into one unit.

The two materials are first fabricated into separate cylindrical bodies.

Then, the two cylindrical bodies (one made of a composite layer and another one made of a metallic layer), are combined into one unit by shrink fitting, press fitting, cold fitting, or the like.

It is also possible to join them with suitable adhesive.

The fabrication of the cylindrical body and/or the driving shaft by the composite material made of reinforcing fibers and a matrix component and the metallic material contributes to the increase of the value $E/\rho$ with respect to the bending vibration over conventionally used materials such as carbon steel or aluminum.

The reason why the metallic layer made of metal, is provided on one or both of the outer surface or inner surface of the composite layer made of reinforcing fibers and a matrix component is such that it is more suitable than the fiber reinforced composite material for portions as a bearing portion or a sliding portion, where mechanical strength, wearing and abrasion resistance, or the like are inherently required.

Whether the metallic material is provided on the outer surface or the surface may be determined based upon the supporting construction of the spindle.

As apparent from the above, the cylindrical body used in this invention is a bobbin holder on which a plurality of bobbins are mounted in a quick and detachable manner.

The bobbins used in the present invention may be made of paper, plastic, or the like as ususal.

The materials thereof are not restricted.

A manner in which the cylindrical body of the spindle is connected to the driving shaft is not restricted, but the cylindrical body is preferably directly connected to the driving shaft through a boss integrally provided on at least one end of the bobbin holder or around a central inside portion of the cylindrical body.

In the present invention, the cylindrical body may be connected directly to the driving shaft through a part of the cylindrical body without using the boss above.

The driving shaft may have any configuration enabling rotation of the cylindrical body.

Preferably, it comprises a composite layer and supporting member the same as the cylindrical body.

The most preferably driving shaft has a composite layer made of reinforcing fibers and a matrix component, provided at the inner portion thereof and the supporting member provided on the outer surface of the composite layer.

Further, the driving shaft may be constructed with or without a hollow tube formed inside the main portion thereof.

When the supporting member is provided on the outer surface of the driving shaft, it need not be formed on the entire surface of the composite layer but may be provided on certain restricted portions such as a bearing portion, a sliding portion, or a junction portion with a motor or the like.

A conventional motor, for example, a DC motor, an induction motor, or synchronous motor can be used as the spindle driving means.

Also, a conventional driving force transmitting means, for example, a coupling device, belt, or gears can be used.

It is preferable that the driving shaft of the spindle be directly connected to a motor, and a rotor of the motor be fixedly mounted on the driving shaft, and a stator be fixedly mounted on a frame of the motor to make the spindle compact.

The length of the cylindrical body is not restricted, but when bobbins having an inner diameter of more than 94 mm ordinarily provided for taking up yarn used for clothing materials (yarn denier less than 250 D), are used, the length is preferably more than 1000 mm, while when bobbins having an inner diameter of more than 73 mm, provided for taking up yarn used for industrial articles (yarn denier more than 250 D), is used, the length is preferably more than 600 mm, in order to reduce the vibration.

When a rotating torque is transferred to the cylindrical body by a driving means through a driving shaft, the value of $E/\rho$ is remarkably increased because, due to the present invention, the density of the overall spindle can be reduced and simultaneously the Young's modulus E can be increased.

Thereby, the critical speed of the cylindrical body of the present invention can be increased from that of a cylindrical body made only of metal.

Further, in the present invetion, since the metallic layer is provided on at least one of an inner surface or an external surface of the composite layer, the mechanical strength, such as the surface strength or sliding performance, is superior to a spindle made only of a fiber reinforced composite material.

EXAMPLES

Examples of the present invention will now be explained with reference to the attached drawings.

EXAMPLE 1

FIG. 1 is a cross-sectional view of a first example of a yarn winding apparatus in which four bobbins are mounted on one spindle.

In FIG. 1, four bobbins 1*a* to 1*d* are serially inserted onto a cylindrical body 3 and four different yarns Y are taken up on outer surfaces of the bobbins.

Elastic rings 2*a* to 2*h* are provided between the external surface of the spindle and inside surface of the bobbins for fixing the bobbins on and releasing them from the spindle.

The elastic rings are arranged on the surface of the spindle with spacers 4a and 4b therebetween.

In FIG. 1, two elastic rings are provided for each bobbin.

The cylindrical body 3 consists of a composite layer 5 made of a fiber reinforced composite material and two supporting members 6 and 7 made of matallic material provided on the two surfaces of the composite layer.

These three layers are stacked and molded to form an integral three layer construction.

In a center of the cylindrical body 3, a boss portion 8 is provided by welding.

A driving shaft 12 having an external diameter of 25 mm is inserted into the boss portion 8 and fixed thereto by a nut 13 at the end of the driving shaft 12.

The driving shaft is formed by a cylindrical body consisting of a composite layer 10 made of a composite layer made of reinforcing fibers and a matrix component having an external diameter of 27 with a through hole 9 having an inner diameter of 4 mm and of a supporting member 11 made of a metallic material and having a thickness of 2 mm and integrally provided on the outer surface of the composite layer 10.

Therefore, the spindle of the present invention consists of the cylindrical body 3, the boss portion 8 and the driving shaft 12.

The driving shaft 12 is rotatably supported by bearings 16a to 16c, the distance between the bearing 16a and 16c being set at 1000 mm, provided in a supporting cylindrical portion 15 integrally mounted on a frame 14 of a motor 20.

On the other hand, a rotor 18 of the motor 20 is fixedly provided on a portion of the driving shaft located between the bearings 16b and 16c, the distance therebetween being set at 450 mm.

A stator 19 of the a motor 20 is fixedly provided inside the frame 14.

Accordingly, the driving means, i.e., the motor 20 for driving the driving shaft consists of a rotor 18 fixedly mounted on the driving shaft and a stator 19 fixedly mounted on the frame 14.

The inner diameter, external diameter, and longitudinal length of the bobbins 1a to 1d are 94 mm, 110 mm, and 300 mm (total bobbin length of 1200 mm).

A supporting member 7 having a cylindrical configuration and an inner diameter and external diameter of 61 mm and 66 mm respectively was produced with a metallic material such as stainless steel(SUS304, JIS G3459, a particular quality grade of steel as defined in the Japanese Industrial Standards,).

A boss portion 8 made of the same metallic material as the cylindrical body was integrally provided inside of the supporting member 7 by welding.

Thereafter, carbon fibers ("TORAYCA" M-50 produced by Toray Industries Inc.) are wound on the surface of the supporting member 7 with a winding angle $\theta$ of 30 degree.

The carbon fibers were immersed in epoxy resin while the ratio of weight of the carbon fiber to the total weight of the composite layer Vf is set at 60%.

The assembly was then heated in a dryer set at a temperature of 130° C. to cure the epoxy resin.

The composite layer 5 thus obtained, was then ground to reduce the external diameter thereof to 78 mm.

An epoxy resin adhesive was coated on the polished surface of the composite layer 5, then a cylindrical supporting member 6 having a thickness of 1 mm was inserted onto the surface of the composite layer 5 and bonded thereto to form a cylindrical body having a three-layer construction, an inner diameter of 61 mm, an outer diameter of 80 mm and total longitudinal length of 1170 mm including a bobbin stopper portion of 5 mm.

The driving shaft 12 was produced by the same production method as that of the cylindrical body except that carbon steel (S55C. JIS G 4051, a particular quality grade of steel as defined in the Japanese Industrial Standards,) was used for the supporting member 11.

In FIG. 1, numeral 21 denots a means for quickly fitting bobbins to and detaching then from the cylindrical body 3.

It comprises a piston 22, a spring 23, a spring washer 24, an O-ring 25, and the like.

The piston 22 can be slide air-tightly inside the cylindrical body 3 with the O-ring.

Thus, in a yarn winding condition, the bobbins 1a to 1d are integrally held on the surface of the cylindrical body 3. That is, the piston 22 is caused to move in the right hand direction observed from FIG. 1, due to the resilient force of the spring 23.

The opposite end of the spring 23 is fixed to the solid projected portion 26. The elastic rings 2a to 2h are thus simultaneously contracted in the axial direction of the cylindrical body to increase external diameter.

Accordingly, the bobbins can be solidly fixed to the cylindrical body 3 by the elastic rings.

When the yarn winding operation is finished, a compressed fluid is supplied into the through hole 9 provided in the composite layer 10 of the driving shaft 12 as seen from the right hand side of FIG. 1.

Therefore, the piston 22 is moved in the left hand direction opposing the resilient force of the spring 23. Thus, the external diameters of the elastic rings 2a to 2h are restored to release the bobbins from the cylindrical body 3.

Figure 2:
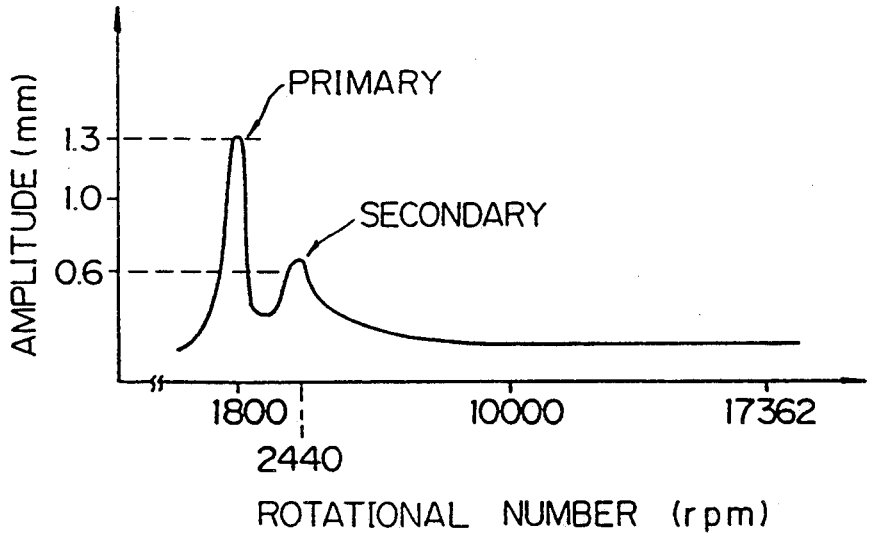
FIG. 2 is a chart indicating a relationship between speed and vibration of a spindle in a yarn winding apparatus of the present invention.

FIG. 2 shows the relationship between the speed of the spindle and the vibration amplitude at the left end of the bobbin 1a.

To examine this relationship in the yarn winding apparatus of this example, four multifilament polyester yarns, each consisting of 36 filaments of a denier of 2.1, were taken up on four paper bobbins at a winding speed of 6000 m/min.

The speed of the spindle was varied from zero to a predetermined 17,362 rpm in order to wind the yarn at the yarn winding speed of 6000 m/min.

As apparent from FIG. 2, a primary critical speed and secondary critical speed appear at around 1800 rpm and 2440 rpm respectively, but no third critical speed appears up to 17,362 rpm, so a continuous high speed yarn winding operation was possible even at 6000 m/min for about seven hours until the winding operaion was completed.

There was no vibration even with a long spindle having a small diameter.

Accordingly, it is apparent that the yarn winding apparatus of this example is a sophisticated high speed apparatus having high reliability and durability free from variation or trouble during a long operation.

The same relationship was examined for a yarn winding apparatus constructed the same as the above but with the cylindrical body 3 and the driving shaft 12 made only of a metallic material such as carbon steel (S55C, JIS G 4051, a particular quality grade of steel as defined in the Japanese Industrial Standards), i.e., no fiber reinforced composite material.

Figure 3:
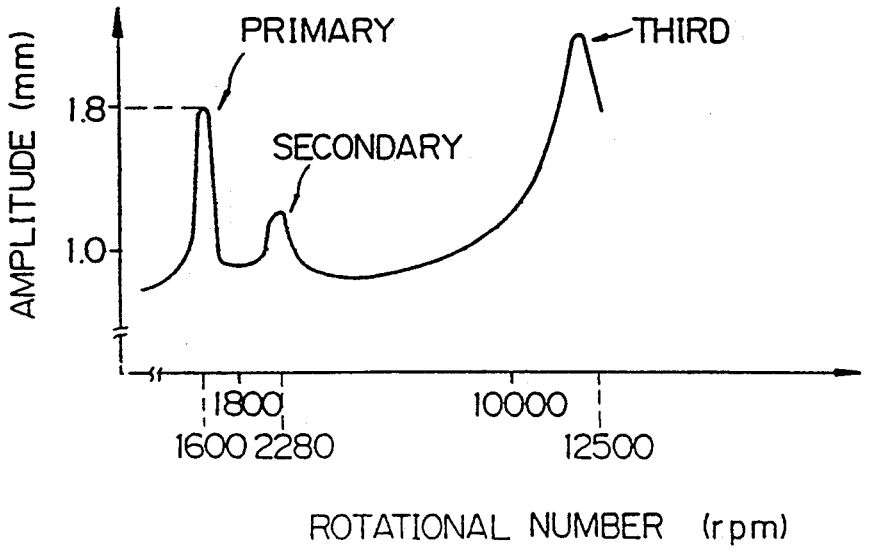
FIG. 3 is a chart indicating a relationship between speed and vibration of a spindle in a yarn winding apparatus of a conventional yarn winding apparatus.

The results are shown in FIG. 3.

As apparent from FIG. 3, a third critical speed appears at a spindle speed of 12,500 rpm with a yarn winding speed of 4320 m/min making impossible high speed yarn winding, the main object of the present invention.

Accordingly, by utilizing the yarn winding apparatus of the present invention, the following effects can be obtained;

(1) Even if one or both of the cylindrical body and the driving shaft of the spindle of the yarn winding apparatus has a small diameter and an elongated length, when one or both of the cylindrical body and the driving shaft comprises a fiber reinforced composite material and a metallic material layer integrally joined with one or both of the inner surface and the outer surface of the composite material layer, the value of $E/\rho$ can be increased, for example, about 2.5 times over the conventional cylindrical body made only of a metallic material and about 4 times over the conventional driving shaft made of only a metallic material, whereby the critcal speed for the yarn winding operation can be increased.

Therefore, the yarn winding speed can be increased by utilizing bobbins having a diameter reduced by the amount the critical speed was increased.

The reduction of the diameter of the bobbins contributes to the reduction of the production cost of bobbins and further the increment of the total yarn weight taken up on the bobbin to form a large yarn package, thereby improving the productivity.

(2) The cylindrical body of the present invention consists mainly of a fiber reinforced composite material, while at least the sliding portion, fitting portion, coupling portion, such as a thread screw portion, and bearing portion are made of a metallic material.

A yarn winding apparatus can be obtained having extremely improved durability and reliability compared with the conventional yarn winding apparatus having a cylindrical body consisting only of a fiber reinforced composite material.

(3) Further, since the weight of the cylindrical body can be reduced compared with the conventional cylindrical body made only of a metallic material, by utilizing a combination of the fiber reinforced composite material layer and the metallic layer, a yarn winding operation with a high yarn speed can be effected with less vibration.

Moreover, the fiber reinforced composite material used inside the cylindrical body of the present invention contributes sufficiently to an attenuating effect, so, the vibration of the cylindrical body in yarn winding operation can be reduced and thus the yarn package can be improved in form.

Additionally, noise generated by such vibration is reduced and the lifetime of the bearings is extended.

EXAMPLE 2

Figure 4:
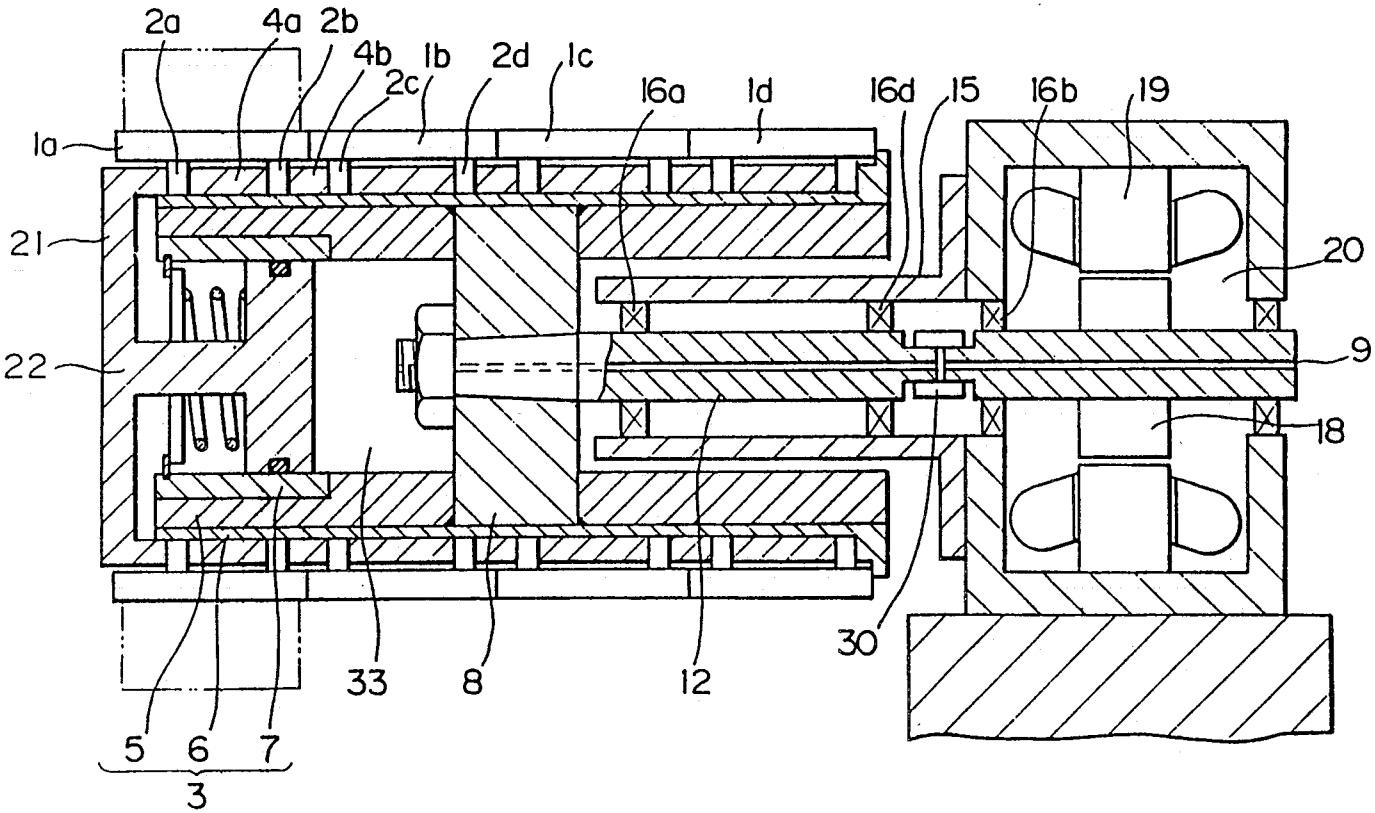
FIGS. 4 and 5 are cross sectional views of other examples of the present invention.

FIG. 4 is a cross-sectional view of a yarn winding apparatus of the second embodiment of the present invention.

In FIG. 4, the main portion of the cylindrical body 3 is made of a two-layered construction consisting of a composite layer 5 made of a fiber reinforced composite material and a supporting member 6 made of a metallic material.

The driving shaft 12 is a conventional one made only of a metallic material.

The cylindrical body 3 was obtained by first, providing a supporting member 6 made of carbon steel (S55C JIS G 4051, a particular quality grade of steel as defined in the Japanese Industrial Standards) having an external diameter of 80 mm, an inner diameter of 76 mm, and a length of 1170 mm including a bobbin stopper portion of 5 mm, then connecting a boss portion 8 made of the same material as the supporting member 6, to a central portion inside the supporting member 6 by welding.

After that, a composite layer 5 was inserted into the supporting member 6 and bonded to the inside surface except where the boss portion 8 had already been provided.

Further, a separate supporting member 7 made of metallic material was inserted into the composite layer 5 and bonded to one end portion enabling slidable support of a piston 22.

The composite layer 5 was produced by the following method; First, a fiber sheet made of carbon fiber, for example, "TORAYCA" M-50 produced by Toray Industries Inc., having a thickness of 0.17 mm was prepared and immersed in epoxy resin. Then, the epoxy resin immersed carbon fiber sheet was cut into a predetermined size.

The cut sheets were overlappingly wound on a surface of a mandrel having an external diameter of 61 mm and having a mold release agent coated on the external surface thereof.

Note that when the sheets were wound on the mandrel one by one, the longitudinal direction of the carbon fiber was kept parallel to the axis of the mandrel and the winding operation was continued until the external diameter of the cylindrical body formed by the carbon fiber sheets had reached 77 mm.

The final product was wrapped with a tape and subjected to heat treatment in a drying furnace at a temperature of 130° C. to cure the epoxy resin and a cylindrical composite layer 5 was obtained by taking off the mandrel from the cylindrical sheet portion and grinding the portion to desired configuration.

The driving shaft 12 was a conventional metallic hollow tube and coupled to the boss portion 8. Shaft 12 is connected to rotor 18 through a coupling means 30.

In this example, the basic construction of the yarn winding apparatus was the same as the yarn winding apparatus shown in Example 1 except that a separate bearing 16*d* was provided and the distance between the bearings 16*a* and 16*d* was set at 500 mm.

In accordance with the same test as performed in Example 1, the level of vibration of the spindle was low, even at a rotational speed of around 17362 rpm, so a yarn winding operation at a high yarn winding speed of 6000 m/min could be effected with bobbins having a reduced diameter.

In this example, a high speed yarn winding operation with bobbins having a reduced diameter can be effected since the value $E/\rho$ of the cylindrical body 3 could be increased 3.5 times over a conventional cylindrical body made only of a metallic material.

If at least a portion of the driving shaft 12 consists of the supporting member 11 and the composite layer 10, the yarn winding operation can be more improved.

In this example, when the composite layer 5 was formed, a mandrel was used for forming the portion where no supporting member 7 was provided on the inner surface of the composite layer 5.

At the portion where the supporting member 7 was provided, the supporting member 7 was used as the mandrel.

However, when a composite layer 5 was formed as mentioned above, the mandrel should be taken out of the cylindrical body, leaving the supporting member 7, in the cooling operation of the composite layer 5.

Therefore, a problem arises in that cracks may be introduced into the composite layer 5 due to the difference of the coefficient of linear expansion between the composite layer 5 and the supporting member 7 generated in the cooling operation.

To avoid this problem, an inclined angle $\beta$ of a longitudinal direction of the carbon fiber in a prepreg to an axial direction of the supporting member 7 or the mandrel was adjusted in order to match the coefficient of linear expansion of the composite layer 5 with that of the supporting member 7.

This was done the following way:

First, the first five sheets were simultaneously wound overlappingly on the mandrel and the supporting member 7 with an inclined angle $\beta$ of 0 degree (longitudinal direction of the carbon fiber was parallel to the axial direction of the supporting member 7).

The next sheet, i.e., the sixth sheet, was wound thereon with an inclined angle $\beta$ of 30 degrees.

The next five sheets were wound thereon in the same manner as the first five sheets with an inclined angle $\beta$ of 0 degree.

Finally, the next, i.e., the 12th sheet, was wound with an inclined angle $\beta$ of $-30$ degrees.

Utilizing this method, the coefficient of linear expansion of the composite layer 5 can be made to almost completly coincide with supporting member 7.

The inclined angle $\beta$ and the number of the wound sheets can be arbitrarily selected in accordance with the desired coefficient of linear expansion.

It is apparent that the method for producing a composite layer 5 of this example can be applied for producing the composite layer 5 in Example 1 as well.

EXAMPLE 3

Figure 5:
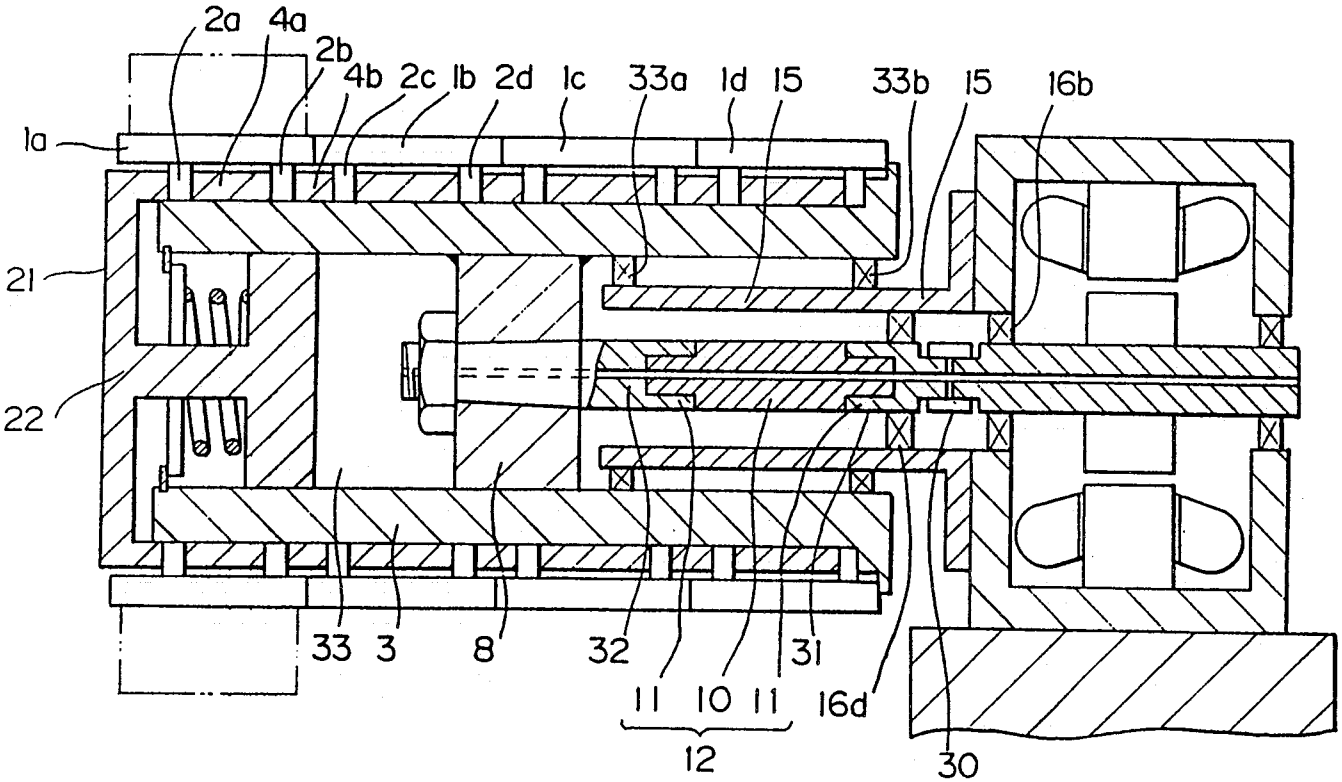

FIG. 5 is a cross-sectional view of a yarn winding apparatus of a third example.

The driving shaft 12 consists of a supporting member 11 and a composite layer 10, both integrally arranged along an axis thereof.

At the contacting portions of the two layers, a portion having a two-layer construction consisting of the supporting member 11 and the composite layer 10 is provided.

The cylindrical body 3 is a conventional one made of carbon steel (S55C JIS G 4051, a particular quality grade of steel as defined in the Japanese Industrial Standards) having an external diameter of 61 mm, an inner diameter of 47 mm, a length of 670 mm including a bobbin stopper portion of 5 mm and a boss portion 8 is provided therein utilizing shrink fitting and welding.

The driving shaft 12 is formed by making the two end portions 31 and 32 of the driving shaft 12 of only a supporting member 11 made of a metallic material and providing between the end portions 31 and 32 a composite layer 10 having an overall longitudinal length of 350 mm, an external diameter of a central portion of 12 mm, and an external diameter and an overall longitudinal length of attenuated portions provided at the two ends of the composite layer 10 of 12 mm and 50 mm, respectively.

Further, this composite layer 10 has a through hole 9 having a diameter of 3 mm.

As shown in FIG. 5, the attenuated portions of the composite layer 10 are inserted into cavity portions provided in the supporting members 11 to form an integral body.

The cylindrical body 3 is rotatably supported by bearings **33*a* and 33*b* provided between the cylindrical body 3 and a solid cylindrical portion 15 fixedly mounted on a motor 20. The distance between the bearings 33*a* and 33*b* and the distance between the bearings 33*b* and 16*b* measured in parallel to the axis of the driving shaft 12** are 350 mm and 50 mm, respectively.

The dimensions of bobbins used in the example, are an inner diameter of 73 mm, an external diameter of 89 mm, and a length of 175 mm.

The total length with four bobbins is 700 mm.

The rest of the conditions of this example are the same as that of Example 2.

The same examination as in Example 1 was carried out.

It was found that the level of vibration of the driving shaft 12 was low even at a rotational speed of around 17,883 rpm, so a yarn winding operation at a desired high yarn winding speed of 5000 m/min could be performed with bobbins having a reduced diameter.

The same examination was carried out on a yarn winding apparatus with a driving shaft 12 having the same dimensions as above but made only of a metallic material (S55C, a particular quality grade of metallic material as defined in the Japanese Industrial Standards).

The vibration caused by the driving shaft was remarkably increased from the speed of about 12,000 rpm.

Therefore, the rotational torque was not fully transmitted to the spindle and thus the yarn winding operation had to be stopped at the speed of at about 12,560 rpm.

This difference in effect is due to the fact that the value of $E/\rho$ of the spindle of this example can be increased about four times over the spindle used in the comparative example.

The invention being thus described, it will be obvious that the same way be varied in many ways. Such variations are not to be regarded as a departure from the spirit and scope of the invention, and all such modifications as would be obvious to one skilled in the art intended to be included within the scope of the following claims.

We claim:

1. A yarn winding apparatus comprising:

(a) a spindle comprising a cylindrical body, bobbins being detachably mounted on an external peripheral surface thereof, and a driving shaft connected to the cylindrical body;

(b) bobbin fitting and detaching means provided on the cylindrical body;

(c) driving means for rotatably driving the spindle; and (d) at least a portion of at least one of said cylindrical body and said driving shaft further comprising a composite layer made of reinforcing fibers and a matrix component and a supporting member made of metal connected to said composite layer.

2. The yarn winding apparatus according to claim 1, wherein said cylindrical body comprises said composite layer and said supporting member.

3. The yarn winding apparatus according to claim 2, wherein at least one supporting member is provided on one of an inner surface and an external surface of said composite layer having a cylindrical configuration.

4. The yarn winding apparatus according to claim 2, wherein said supporting member is provided on an outer surface of said composite layer.

5. The yarn winding apparatus according to claim 2, wherein said supporting member is provided on each of an inner surface and an outer surface of said composite layer.

6. The yarn winding apparatus according to claim 1, wherein said driving shaft comprises said composite layer and said supporting member.

7. The yarn winding apparatus according to claim 6, wherein said supporting member is provided on an outer surface of said composite layer.

8. The yarn winding apparatus according to claim 1, wherein said cylindrical body comprises said composite layer and said supporting member, said supporting member being provided on an inner surface of the composite layer, and a connecting portion between said cylindrical body and said driving shaft comprises a boss provided on an inner surface of sid supporting member of said cylindrical body and said driving shaft is detachably connected to said boss.

9. The yarn winding apparatus according to claim 1, wherein a longitudinal length of said cylindrical body is more than 1000 mm.

10. The yarn winding apparatus according to claim 1, wherein said reinforcing fibers are inorganic fibers and said matrix component is a resin.

11. The yarn winding apparatus according to claim 10, wherein said inorganic fibers are carbon fibers.

12. The yarn winding apparatus according to claim 10, wherein said inorganic fibers are glass fibers.

13. The yarn winding apparatus according to claim 10, wherein said resin substance is epoxy resin.

14. The yarn winding apparatus according to claim 1, wherein said reinforcing fibers are organic fibers and said matrix component is a resin.

15. The yarn winding apparatus according to claim 14, wherein said organic fibers are aramid fibers.

16. The yarn winding apparatus according to claim 1, wherein said reinforcing fibers are metallic fibers and said matrix component is metal.

17. The yarn winding apparatus according to claim 1, wherein a ratio of said reinforcing fibers to said matrix component is in the range of from 40 to 75%.

18. The yarn winding apparatus according to claim 17, wherein said ratio is in the range of from 50 to 70%.

19. The yarn winding apparatus according to claim 2, wherein said cylindrical body comprises said composite layer and said supporting member, said supporting member being provided on an outer surface of said composite layer, and a connecting portion between said cylindrical body and said driving shaft comprises a boss provided on an inner surface of said supporting member of said cylindrical body and said driving shaft is detachably connected to said boss.

20. The yarn winding apparatus according to claim 2, wherein said driving shaft comprises a first portion being formed with said supporting member, a second portion being formed with said composite layer and said supporting member, a third portion being formed with said composite layer, a fourth portion being formed with said composite layer and said supporting member and a fifth portion being formed with said supporting member.

* * * * *